US012006181B2

(12) United States Patent
Prediger et al.

(10) Patent No.: US 12,006,181 B2
(45) Date of Patent: Jun. 11, 2024

(54) TEXTILE MACHINE PRODUCING CROSS-WOUND PACKAGES

(71) Applicant: SAURER SPINNING SOLUTIONS GmbH & CO. KG, Übach-Palenberg (DE)

(72) Inventors: Eduard Prediger, Mönchengladbach (DE); Michael Spitzer, Monschau-Kalterherberg (DE); Heiko Toepke, Baesweiler (DE); Jonathan Sprecher, Aachen (DE); Philipp Schiffers, Erkelenz-Gerderath (DE); Wolfgang Doerner, Mönchengladbach (DE); Harald Wassen, Schwalmtal (DE)

(73) Assignee: Saurer Spinning Solutions GmbH & Co. KG, Übach-Palenberg (DE)

( * ) Notice: Subject to any disclaimer, the term of this patent is extended or adjusted under 35 U.S.C. 154(b) by 175 days.

(21) Appl. No.: 16/850,242

(22) Filed: Apr. 16, 2020

(65) Prior Publication Data

US 2020/0331721 A1 Oct. 22, 2020

(30) Foreign Application Priority Data

Apr. 18, 2019 (DE) ..... 102019110295.2

(51) Int. Cl.
*D01H 9/18* (2006.01)
*B65H 54/26* (2006.01)
*B65H 67/06* (2006.01)

(52) U.S. Cl.
CPC ..... *B65H 54/26* (2013.01); *B65H 67/068* (2013.01); *D01H 9/18* (2013.01); *B65H 2701/31* (2013.01)

(58) Field of Classification Search
CPC ..... B65H 67/068; B65H 54/26; D01H 9/18
See application file for complete search history.

(56) References Cited

U.S. PATENT DOCUMENTS 5,184,305 A 2/1993 Gronenberg
2018/0282910 A1* 10/2018 Brandl ..... B65H 67/068

FOREIGN PATENT DOCUMENTS

CN 1163855 A 11/1997
DE 19518276 A1 11/1996
(Continued)

OTHER PUBLICATIONS

Office Action from Indian Patent Application No. 202024016178, dated Nov. 30, 2021, all enclosed pages cited.

*Primary Examiner* — William E Dondero
(74) *Attorney, Agent, or Firm* — Nelson Mullins Riley & Scarborough LLP

(57) ABSTRACT

A textile machine for producing cross-wound packages, which has a plurality of workstations on the two longitudinal sides of the machine and is equipped with a tube magazine arranged at an end of the machine, the tube magazine having a plurality of empty-tube transport rows, driven by electric motor and loaded with empty tubes of different yarn lots. In order to avoid the fixed division of the empty-tube transport rows that hitherto was defined by the construction of the tube magazine and thus to avoid limited variations in the yarn lot management, the invention provides for the empty-tube transport rows to be equipped with electric drives, which are connected to a control unit of the textile machine, the machine control system being designed in such a way that different lot management programs are set by software.

4 Claims, 3 Drawing Sheets

(56) References Cited

FOREIGN PATENT DOCUMENTS

| | | | |
|---|---|---|---|
| DE | 19905856 | A1 | 8/2000 |
| DE | 4338552 | C2 | 8/2002 |
| EP | 0262726 | A2 | 4/1988 |
| EP | 0916614 | A2 | 5/1999 |

* cited by examiner

TEXTILE MACHINE PRODUCING CROSS-WOUND PACKAGES

CROSS-REFERENCE TO RELATED APPLICATIONS

This application claims priority from German National Patent Application No. 10 2019 110 295.2, filed Apr. 18, 2019, entitled "Textile Machine Producing Cross-Wound Packages", the entire contents of which are incorporated herein by reference.

FIELD OF THE INVENTION

The invention relates to a textile machine for producing cross-wound packages, which has a plurality of workstations on the two longitudinal sides of the machine and is equipped with a tube magazine arranged at an end of the machine, the tube magazine having a plurality of empty-tube transport rows, which can be driven by electric motor and can be loaded with empty tubes of different yarn lots.

BACKGROUND OF THE INVENTION

Textile machines producing cross-wound packages have long been known in various embodiments and are described, in some cases in considerable detail, in numerous patent applications.

European Patent Publications EP 0 916 614 B1 and EP 0 262 726 A2, for example, disclose textile machines producing cross-wound packages, which are each equipped with a tube magazine arranged at an end of the machine.

European Patent Publication EP 0 916 614 B1 describes an automatic winding machine equipped with a tube magazine positioned at an end of the machine, which tube magazine has a tube transfer device for transferring empty tubes to an empty-tube transport device running the length of the machine and has a storage device for accommodating a plurality of empty tubes. The storage unit, which has several storage columns arranged next to one another, each with several loading chutes for the empty tubes, which loading chutes are arranged one above the other, is fastened to a central unit in such a way that the storage unit can be easily exchanged. The tube transfer device, for its part, is equipped with a vertically movable gripper carrier, which is fitted with at least one controllable tube gripper and can be positioned in such a way that empty tubes stored in the storage columns of the storage unit can be transferred in a targeted manner to the empty-tube transport device of the automatic winding machine, which empty-tube transport device runs the length of the machine.

However, the known device is quite complicated and sensitive in its construction and is severely limited with respect to size due to its storage unit, which is exchangeably fastened to the central unit. This means that the storage unit disclosed in European Patent Publication EP 0 916 614 B1 is not very suitable for open-end rotor spinning machines which have a plurality of workstations on both longitudinal sides of the machine, which workstations have to be continuously supplied with tip-oriented empty tubes.

A textile machine producing cross-wound packages, having a comparable storage device, is also described in European Patent Publication EP 0 262 726 A2. This known automatic winding machine likewise has a tube magazine at an end of the machine. The tube magazine consists of one or more storage devices arranged one behind the other, each of which is connected via a tube chute to an empty-tube conveyor belt running the length of the machine. The storage devices each have a circulating, sinusoidally arranged endless traction element, to which arbours for empty tubes are attached. During winding operation, the empty tubes stored on the arbours are conveyed to a tube transfer position, and there the empty tubes are transferred by means of a tube slider onto the empty-tube conveyor belt, which takes the empty tubes to the workstations.

As indicated above in connection with European Patent Publication EP 0 916 614 B1, the device disclosed in European Patent Publication EP 0 262 726 A2 is also not very suitable for a textile machine producing cross-wound packages which has a plurality of workstations on both longitudinal sides of the machine, which workstations have to be continuously supplied with tip-oriented empty tubes.

German Patent Publication DE 199 05 856 A1 describes an open-end rotor spinning machine which has a plurality of workstations on both longitudinal sides of the machine between its end frames and has a tube magazine arranged at an end of the machine. The workstations, each of which, as usual, has a spinning apparatus and a downstream winding apparatus, are connected to the tube magazine via an empty-tube transport device. This means that, during spinning operation, the workstations are supplied with fresh empty tubes by means of empty-tube conveyor belts, these empty tubes being delivered tip-oriented and being processed by a service unit.

The central tube magazine, which is arranged at an end of the machine, has several transport chains, which are arranged next to one another in a side view and are equipped with arbours; these transport chains are coupled by means of a shaft and driven by a common electric motor. The empty tubes held ready on the arbours of the tube magazine are transferred by a "tube slider" onto a endlessly circulating troughed belt, which can be controlled cyclically and forwards the empty tubes successively either to a tube turner or to a downstream tube transfer position.

The known device allows a relatively fast, reliable supply of tip-oriented empty tube to the workstations of an open-end rotor spinning machine arranged on both longitudinal sides of the machine. However, the device is rather inflexible, in particular due to the common drive of the transport chains of the tube magazine. This means that the device described in German Patent Publication DE 199 05 856 A1 does not make it possible to process several yarn lots simultaneously on the open-end rotor spinning machine.

In practice, therefore, the device described above has already been revised such that several transport and storage chains that can be driven by separate electric motors are installed in the area of the tube magazine. This means that the tube magazine has several, for example twelve, transport and storage chains for empty tubes, which transport and storage chains are arranged next to one another. The transport and storage chains 1 to 4, the transport and storage chains 5 to 7, the transport and storage chains 8 to 10 and the transport and storage chains 11 and 12 are equipped with a separate drive in each case.

Having a tube magazine configured in this manner does allow different yarn lots to be produced at the same time, but this improved embodiment of a tube magazine suffers from the considerable disadvantage that variations in lot management are limited by the design of the tube magazine. This means that a maximum of four yarn lots can be produced simultaneously with a tube magazine configured as described above, unless conversion measures are taken.

SUMMARY OF THE INVENTION

Proceeding from the prior art described above, the problem addressed by the invention is that of taking a textile machine producing cross-wound packages which has a plurality of workstations on the two longitudinal sides of the machine and is equipped with a tube magazine arranged at an end of the machine, which tube magazine has several empty-tube transport rows, which can be driven by electric motor and can be loaded with empty tubes of different yarn lots, and improving it in such a way that yarn lot management of greater variability with regard to the tube magazine is provided, without any changes having to be made to the construction of the tube magazine.

This problem is solved according to the invention in that the empty-tube transport rows are equipped with electric drives connected to a control unit of the textile machine, the control unit being configured in such a way that different lot management programs can be set by software.

The dependent claims relate to advantageous configurations of the invention.

The design according to the invention has, in particular, the advantage that, if required, different lot management programs for the empty-tube transport rows of the tube magazine can be set quickly and easily at the control unit. This means that, on a textile machine producing cross-wound packages, the tube magazine of which textile machine is configured according to the invention, not only can several different yarn lots be produced at the same time and the drives of the empty-tube transport rows be controlled accordingly by the control unit, but also, if necessary, the operation of the tube magazine can be adapted to a changed lot management program without difficulties. Adaptation to a new lot management program is carried out simply by adjusting the control programs of the control unit accordingly. No changes to the construction of the tube magazine are necessary in this regard. The control unit can be designed as a machine control system. The control unit can also be formed by one or more workstation control systems or by the control system of a service unit. A higher-level computer that simultaneously manages several textile machines can also be used as the control unit.

Preferably, the lot management programs of the control unit can be adjusted to a different number of yarn lots. By means of the lot management programs, the empty-tube transport rows of the tube magazine can preferably be assigned to a certain specifiable yarn lot.

According to an advantageous embodiment, the electric drives of the empty-tube transport rows are controlled by the control unit in accordance with the set lot management programs.

This means that, by means of a tube magazine according to the invention, which has, for example, twelve individually motor-driven empty-tube transport rows, all empty-tube transport rows can be loaded with empty tubes of different yarn lots in a first operation if required.

In a subsequent operation, the tube magazine can, for example, be loaded with empty tubes of four different yarn lots without any conversion work being necessary, in which case, for example, four empty-tube transport rows are loaded with empty tubes of a yarn lot A, four empty-tube transport rows with empty tubes of a yarn lot B, two empty-tube transport rows with empty tubes of a yarn lot C and two empty-tube transport rows with empty tubes of a yarn lot D. It is advantageous for each of the empty-tube transport rows of the tube magazine to be loaded with empty tubes of a certain specifiable yarn lot. Such a configuration ensures that when a workstation signals a requirement, it will always be supplied quickly and reliably with a correct empty tube.

Adjacent empty-tube transport rows of the tube magazine can each be loaded with empty tubes of a different yarn lot. Such a configuration makes it possible to produce different yarn lots at the same time on a textile machine producing cross-wound packages, it being ensured, by means of the lot management program which can be set by software, that each of the workstations of the textile machine is always supplied quickly and reliably with a requested empty tube.

Preferably, each of the empty-tube transport rows of the tube magazine is equipped with an individual drive, which is designed as an individual drive and is connected to the control unit of the textile machine. Such an embodiment enables, in a simple and reliable manner, safe operation of a textile machine producing cross-wound packages, which has a plurality of workstations on the two longitudinal sides of the machine and is equipped with a tube magazine arranged at an end of the machine, which tube magazine has empty-tube transport rows, each of which is loaded with empty tubes of a certain yarn lot. This means that, by controlling the empty-tube transport rows of a tube magazine of this kind appropriately, it is relatively easy to ensure that the workstations are supplied with empty tubes of a required yarn lot at all times.

In an alternative embodiment, however, it is also possible for several of the empty-tube transport rows of the tube magazine to have a common drive which is connected to the control unit of the textile machine. This means that, in the case of a textile machine producing cross-wound packages, on which textile machine large, extensive yarn lots are usually produced, meaning that empty tubes of the same yarn lot are always required at a plurality of the workstations of the textile machine, the design of the tube magazine can be simplified due to the presence of such a common drive and thus made more economical. In such a case, of course, all the empty-tube transport rows combined into one transport unit are loaded with empty tubes of the same yarn lot. The use of a common drive for two empty-tube transport rows represents a particularly advantageous compromise between the complexity of the design and the flexibility of the lot management.

The drives for the empty-tube transport rows are, in an advantageous embodiment, designed as stepper motors. Such stepper motors are mass-produced components that are commercially available at low cost and that have proven themselves as drives in textile machine construction in various areas of application. Such stepper motors are characterized, for example, in that the angle of rotation of their rotors can always be precisely set without great control complexity.

Further areas of applicability of the present invention will become apparent from the detailed description provided hereinafter. It should be understood that the detailed description and specific examples, while indicating the preferred embodiments of the invention, are intended for purposes of illustration only and are not intended to limit the scope of the invention.

BRIEF DESCRIPTION OF THE DRAWINGS

Further details of the invention can be taken from an embodiment example explained below on the basis of the drawings.

DESCRIPTION OF THE PREFERRED EMBODIMENTS

Figure 1:
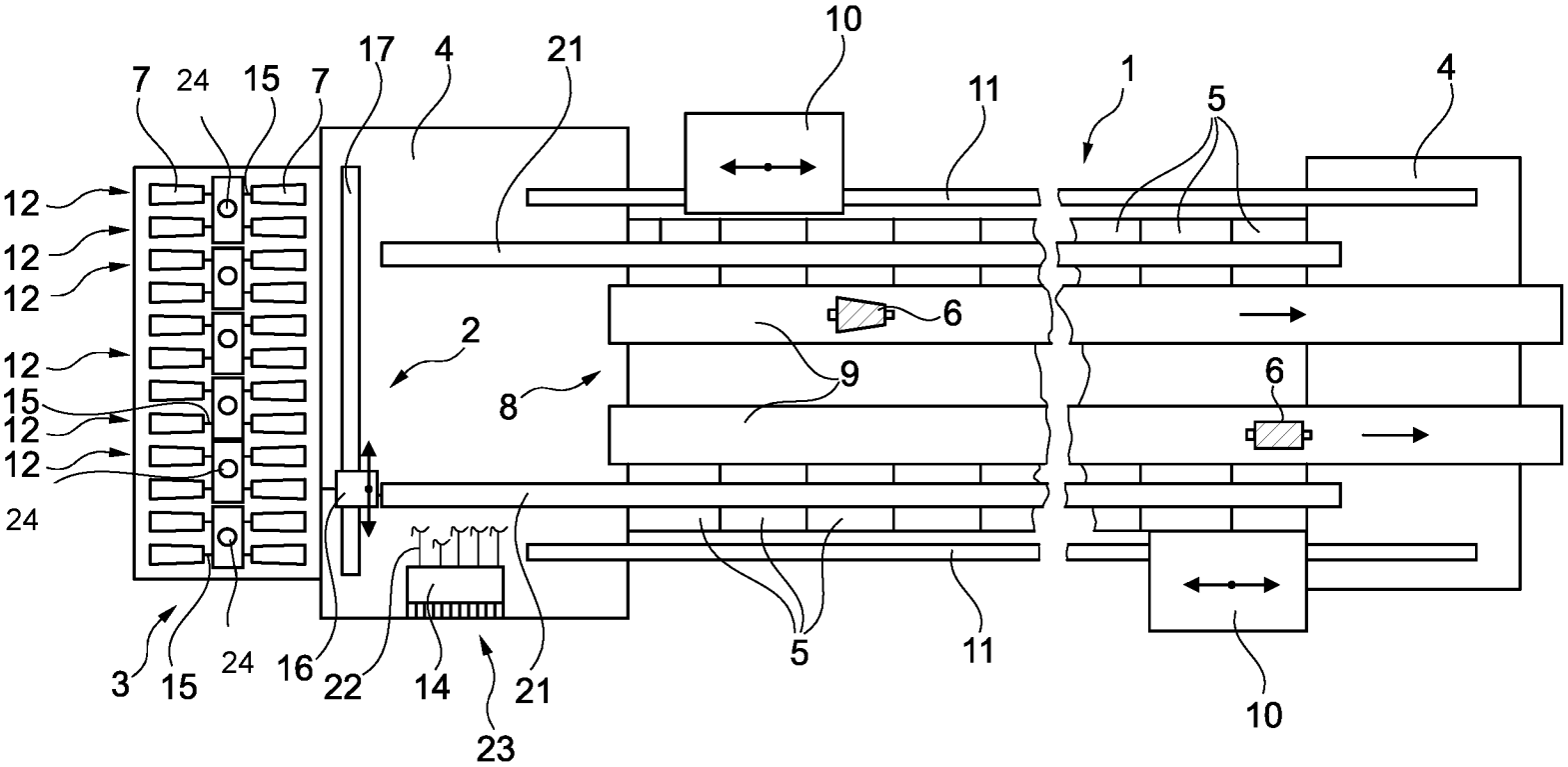
FIG. 1 shows a schematic plan view of a first embodiment of a tube magazine arranged at an end of an open-end rotor spinning machine.

Referring to the figures, FIG. 1 shows a first embodiment of a tube magazine 3, which is arranged in the area at an end of a textile machine producing cross-wound packages and is connected to a control unit and can be operated by the control unit with variable lot management. The control unit is designed as a machine control system 14 here. The textile machine producing cross-wound packages is designed as an open-end rotor spinning machine 1 and has, as is known, a plurality of workstations 5 between its end frames 4, said workstations 5 being arranged on both machine longitudinal sides of the open-end rotor spinning machine 1. A common drive 24 is used for a maximum of two empty-tube transport rows.

The workstations 5, which, as is usual and therefore not shown in more detail, each have a spinning apparatus and a downstream winding apparatus, are supplied during the spinning/winding operation by multiple service units 10, which, for example, are mounted movably on a rail construction 11. The service units 10, generally "doffing and clearing trolleys", take action when there is a service case at one of the workstations.

Such a service case exists, for example, if a cross-wound package 6 has reached its specified diameter at one of the workstations 5 and must be exchanged for a fresh empty tube 7.

Open-end rotor spinning machines 1 of this kind also have what is referred to as a cross-wound package transport device 8, i.e. such textile machines have conveyor belts 9 running the length of the textile machines between the workstations 5 of the textile machines, which conveyor belts 9 are provided for removing finished cross-wound packages 6.

Such open-end rotor spinning machines 1 are also often equipped with an empty-tube supply device, which chiefly consists of the tube magazine 3 arranged at an end of the machine, a tube distribution device 2 and empty-tube conveyor belts 21 running the length of the machine. If necessary, fresh empty tubes 7 are transported from the tube magazine 3 to the workstations 5 by means of the empty-tube conveyor belts 21.

Figure 2:
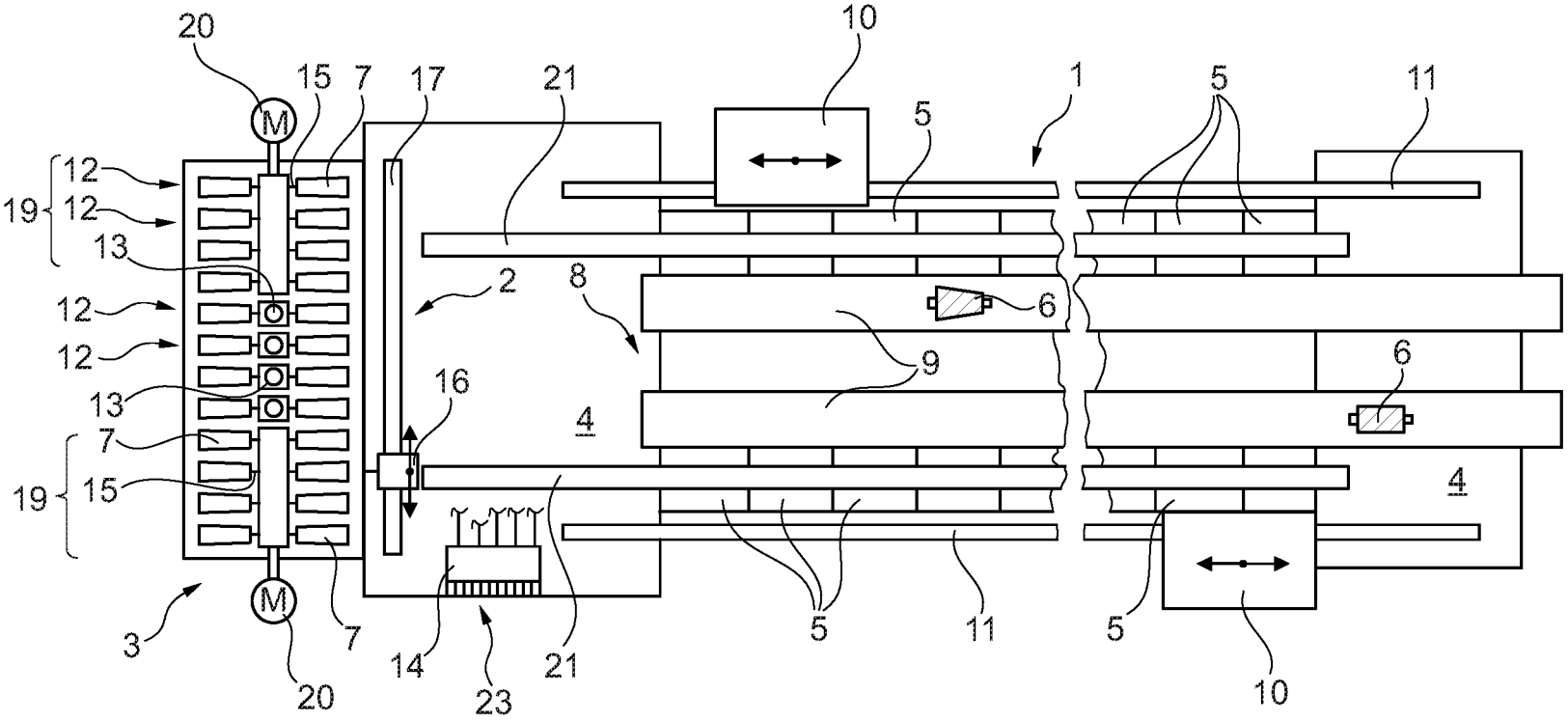
FIG. 2 shows a schematic plan view of a further embodiment of a tube magazine arranged at an end of an open-end rotor spinning machine, in which case some of the empty-tube transport rows are combined into transport units having a shared motor.

Referring to FIG. 2, tube magazine 3, for its part, has a plurality of empty-tube transport rows 12. The individual drives 13 are configured as electric drives, preferably as stepper motors, and are connected to a machine control system 14 of the open-end rotor spinning machine 1. The machine control system 14 is configured in such a way that it is possible to set, by software, which control program the individual drives 13 are operated with. This means that different lot management programs of the tube magazine 3 can be set by software at the machine control system 14.

Figure 3:
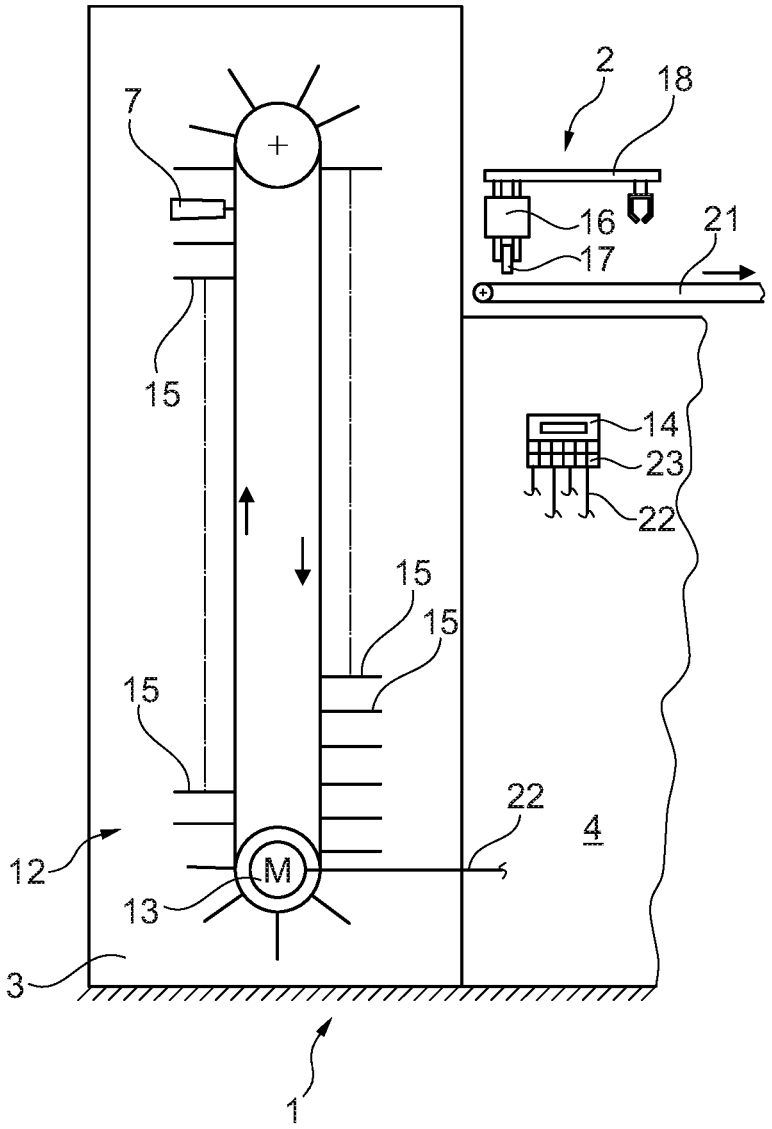
FIG. 3 shows a sectional view of a tube magazine arranged at an end of an open-end rotor spinning machine and connected to the control unit of a textile machine, viewed from the front of the open-end rotor spinning machine.

As can be seen in particular from FIG. 3, the numerous empty-tube transport rows 12 of the tube magazine 3, arranged next to one another, each have a plurality of tube arbours 15, on each of which an empty tube 7 is deposited in a tip-oriented manner. If required, the empty tubes 7 can be transferred onto one of the empty-tube conveyor belts 21 by the tube distribution device 2.

In the present embodiment example, the tube distribution device 2 has a tube carriage 16, which can be moved along the empty-tube transport rows 12 of the tube magazine 3 on a rail construction 17 and is equipped with a rotatably mounted tube gripper 18.

The embodiment example according to FIG. 2 differs from the embodiment example according to FIG. 1. In FIG. 2 some of the empty-tube transport rows 12 are combined into transport units 19. This means that several of the empty-tube transport rows 12 have a common drive 20, which is connected to the machine control system 14 of the open-end rotor spinning machine 1.

The shared drives 20 are also preferably configured as stepper motors and connected to the machine control system 14 of the open-end rotor spinning machine 1, which is configured in such a way that the control programs for the individual drives 13 and the drives 20 can be set at any time by software in such a way that the tube magazine 3 can be operated with different lot management programs.

FIG. 3 shows a sectional view of a tube magazine 3 according to the invention arranged in the end area of a textile machine producing cross-wound packages.

As can be seen, a tube magazine 3 is arranged next to the end frame 4 of an open-end rotor spinning machine 1, which tube magazine 3 has empty-tube transport rows 12, each of which is equipped with a plurality of tube arbours 15 for storing empty tubes 7. The tube magazine 3 has a plurality, for example twelve, of these empty-tube transport rows 12, which are arranged one behind another as seen in the viewing direction of FIG. 3.

In a first embodiment, each of the empty-tube transport rows 12 is equipped with an individual drive 13, which is connected to the machine control system 14 of the open-end rotor spinning machine 1 via a control line 22. As already explained above, the machine control system 14 is configured in such a way that the control program for the individual drives 13 can be set by software, for example via a keyboard 23 of the machine control system 14, in such a way that the tube magazine 3 can be operated with specifiable different lot management programs.

In the area of the tube magazine 3, a tube distribution device 2 is also installed, which has a tube carriage 16, which can move on rails 17 and is equipped with a rotatably mounted tube gripper 18.

If required, the tube carriage 16 draws a requested empty tube 7 from a tube arbour 15 of the relevant empty-tube transport row 12 and transfers the empty tube 7 to the empty-tube conveyor belt 21 that leads to the workstation 5 requesting the empty tube 7.

Function of the Device (Explained Using the Embodiment Example in FIG. 1):

Before each start of operation, the tube magazine 3 is first "loaded". This means that the numerous empty-tube transport rows 12 of the tube magazine 3 are each loaded with empty tubes 7 of a certain yarn lot, and empty-tube transport rows 12 arranged next to one another may well have empty tubes 7 of different yarn lots.

Furthermore, the machine control system 14 of the open-end rotor spinning machine 1 is set by software in such a way as to ensure that, if necessary, a requesting workstation 5 is always supplied with an empty tube 7 of the correct yarn lot. This means that, if one of the cross-wound packages 6 has reached its prescribed diameter in the course of regular spinning operation at one of the workstations 5 and must be replaced as quickly as possible with a fresh empty tube 7, the control device of the relevant workstation 5 requests a service unit 10, for example a doffing and clearing trolley, which then travels to the workstation 5 in question and engages there. Subsequently, a cross-wound package/empty tube change is initiated by the service unit 10, i.e. the completed cross-wound package 6 is transferred by the service unit 10 to a cross-wound package transport device 8 arranged behind the workstations 5, which transports the completed cross-wound package 6 to a package transfer station arranged at an end of the machine. Simultaneously, the service unit 10 or the relevant workstation 5 requests a fresh empty tube 7 of the relevant yarn lot from the central tube magazine 3.

When a fresh empty tube 7 is requested, the lot management program of the tube magazine 3, which is set by software using the machine control system 14, activates the relevant empty-tube transport row 12 of the tube magazine 3, i.e. the empty-tube transport row 12 that is loaded with empty tubes 7 of the requested yarn lot. The relevant empty-tube transport row 12 is positioned, for example, in such a way that the empty tube 7 can be gripped by a tube distribution device 2 and transferred onto an empty-tube conveyor belt 21. This means that a tube carriage 16, which is mounted for movement along the empty-tube transport rows 12 of the tube magazine 3 on a rail construction 17 and is equipped with a movable tube gripper 18, positions itself in the area of the relevant empty-tube transport row 12, grips the relevant empty tube 7 by means of the tube gripper 18 of the tube carriage 16 and transfers the relevant empty tube 7 onto the correct empty-tube conveyor belt 21.

The empty-tube conveyor belt 21 then conveys the requested empty tube 7 as quickly as possible in a tip-oriented manner to the relevant workstation 5, where the empty tube 7 is picked up by the service unit 10 and inserted into the package cradle of the workstation 5.

The cross-wound package/empty tube changing cycle is thereby concluded, and the spinning process can be restarted at the relevant workstation 5.

LIST OF REFERENCE SIGNS

1 Open-end rotor spinning machine
2 Tube distribution device
3 Tube magazine
4 End frame
5 Workstation
6 Cross-wound package
7 Empty tube
8 Cross-wound package transport device
9 Package conveyor belt
10 Service unit
11 Rail construction
12 Empty-tube transport row
13 Individual drive
14 Machine control system
15 Tube arbour
16 Tube carriage
17 Rail
18 Tube gripper
19 Transport unit
20 Drive
21 Empty-tube conveyor belt
22 Control line
23 Keyboard; 24 common drive It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements.

What is claimed is:

1. A textile machine for producing cross-wound packages, having a plurality of workstations on the two longitudinal sides of the machine and equipped with a tube magazine arranged at an end of the machine, the tube magazine having several empty-tube transport rows, driven by electric motor and loaded with empty tubes of different yarn lots, characterized in that the empty-tube transport rows are equipped with electric drives connected to a control unit of the textile machine, a common drive is used for maximum two empty-tube transport rows, the control unit being configured in such a way that different lot management programs are set by software, and each of the lot management programs of the control unit is set to a different number of yarn lots, without any changes having to be made to construction of the tube magazine.

2. The textile machine for producing cross-wound packages according to claim 1, characterized in that the empty-tube transport rows of the tube magazine are assigned to a certain specifiable yarn lot by the lot management programs.

3. The textile machine for producing cross-wound packages according to claim 1, characterized in that the electric drives of the empty-tube transport rows are controlled by the control unit in accordance with the set lot management programs.

4. The textile machine for producing cross-wound packages according to claim 1, characterized in that the electric drives for the empty-tube transport rows are designed as stepper motors.

* * * * *